US005885143A

United States Patent [19]

Ichikawa et al.

[11] Patent Number: 5,885,143

[45] Date of Patent: Mar. 23, 1999

[54] DISK TEXTURING APPARATUS

[75] Inventors: Hisayoshi Ichikawa, Minami-ashigara; Takahisa Ishida, Hadano, both of Japan

[73] Assignee: Hitachi Electronics Engineering Co., Ltd., Tokyo, Japan

[21] Appl. No.: 896,014

[22] Filed: Jul. 17, 1997

[51] Int. Cl.[6] ..... B24B 7/00; B24B 9/00

[52] U.S. Cl. ..... 451/168; 451/317

[58] Field of Search ..... 451/168, 170, 451/291, 178, 211, 303, 307, 317, 55, 324, 28, 59, 163, 67, 158, 271, 292, 63

[56] References Cited

U.S. PATENT DOCUMENTS

| | | | |
|---|---|---|---|
| 3,793,779 | 2/1974 | Perrella | 451/67 |
| 4,347,689 | 9/1982 | Hammond | 451/63 |
| 4,412,400 | 11/1983 | Hammond | 451/163 |
| 4,514,937 | 5/1985 | Gehrung et al. | 451/28 |
| 4,535,567 | 8/1985 | Seaborn | 451/317 |
| 4,656,790 | 4/1987 | Mukai et al. | 451/303 |
| 4,736,475 | 4/1988 | Ekhoff | 451/317 |
| 4,930,259 | 6/1990 | Kobylenski et al. | 451/303 |

*Primary Examiner*—Timothy V. Eley
*Assistant Examiner*—Derris Holt Banks
*Attorney, Agent, or Firm*—Oblon, Spivak, McClelland, Maier & Neustadt, P.C.

[57] ABSTRACT

A disk texturing apparatus for texturing surfaces of a magnetic disk or the like with cross-pattern grooves. The texturing apparatus is basically constituted by a rotational drive having a spindle for supporting and rotating a disk, and a tape transport mechanism for moving a texturing tape across and in pressed with a texturing surface of said disk. The spindle of the rotational drive mechanism is arranged to hold a disk in an eccentrically deviated position off the rotational axis of the rotational drive. As a result, the disk is revolved along an eccentrically deflecting orbit around the rotational axis of said rotational drive while being rotated with the spindle, moving in and out in radial directions in a degree commensurate with the amount of deviation from said rotational axis to form cross-pattern grooves on the disk surface.

5 Claims, 5 Drawing Sheets

DISK TEXTURING APPARATUS

BACKGROUND OF THE INVENTION

1. Field of the Art

This invention relates to a disc texturing apparatus, and more particularly to an apparatus for texturing surfaces of a magnetic disk or similar data storage medium of annular shape with fine intersecting grooves while the disk is put in rotation on a spindle of a rotational drive mechanism.

2. Prior Art

It has been the usual practice in the art to form fine grooves on the surface of a magnetic disk or similarly annular magnetic data storage medium by the so-called texturing operation, for the purpose of improving magnetic head fly characteristics through reduction of frictions and at the same time for improving magnetic orientation of the storage medium coated on the disk surface.

In texturing operations of this nature, combinations of a texturing tape or tapes and abrasive particles have been widely resorted to as means for abrading disk surfaces. Abrasive particles are either deposited on a texturing tape or dispersed in and fed by an abrasive carrier liquid. For instance, in a texturing operation using an abrasive carrier liquid containing abrasive particles in dispersed state, a disk is mounted on a spindle for rotation therewith, and the abrasive carrier liquid is fed to between the texturing surface of the rotating disk and the texturing tape which is pressed against the disk surface under a predetermined load. While rotating the disk on the spindle, the texturing tape is transported along and across the rotating disk surface with the abrasive particles of the abrasive carrier liquid in pressed contact with the disk surface. As a result, the disk surface is textured with circumferential grooves by scratching or abrading actions of the abrasive particles.

When a texturing tape is simply transported across the surface of a rotating disk, the disk surface is textured with circumferential grooves lying concentrically around the center of the disk. In this connection, texturing with cross-pattern grooves is proposed U.S. Pat. No. 4,973,496, forming intersecting grooves on the disk surface for replenishment of a lubricant which is generally applied on the textured disk surface in a subsequent stage. According to the just-mentioned U.S. patent, the texture of cross-pattern grooves is advantageous especially from the standpoint of magnetic head lift characteristics because, even if a lubricant should wear off in certain localities of the disk surface, it can be replenished from other regions through intersections of the cross-pattern grooves, constantly maintaining a uniform lubricant film all over the disk surface.

In order to form cross-pattern grooves, it has been required to move the texturing tape back and forth along the texturing disk surface and in radial directions of the disk, in addition to the rotation of the disk and the transport of the texturing tape. For this purpose, the above-mentioned prior art U.S. patent employs a tape transport mechanism having a roller for pressing the texturing tape against the disk surface and mounted on an oscillating frame structure which is driven by a motor for reciprocating movements in radial directions parallel with the disk surface. In this case, however, there always arises a problem that, as the frame structure is moved back and forth parallel with the disk surface, the disk is shaken or vibrated under the influence of inertial forces at the stroke ends of the oscillating frame structure depending upon the mass of the roller or other component parts which are mounted on the oscillating frame structure, as a result disturbing the uniformity of texture grooves to be formed on the disk. The inertial forces at the stroke ends become greater and the vibrations of the disk are magnified to such a degree as to jeopardize formation of uniform texture grooves especially in case the rotational speed of the disk and the speed of reciprocating movement of the roller are increased for the purpose of accelerating the texturing operation.

SUMMARY OF THE INVENTION

In view of the situations as stated above, it is an object of the present invention to provide a disk texturing apparatus which can form fine texture grooves smoothly on the surface of a disk with a higher degree of precision.

It is another object of the present invention to provide a disk texturing apparatus which can form fine cross-pattern grooves on the surface of a disk accurately in an accelerated manner.

It is still another object of the present invention to provide a disk texturing apparatus which can form fine texture grooves of uniform width and depth accurately on the surface of a disk.

It is a further object of the present invention to provide a disk texturing apparatus which is capable of texturing disk surfaces with fine grooves free of burrs as usually found sticking out on the disk surface after a texturing operation.

In accordance with the present invention, the above-stated objectives are achieved by the provision of a tape texturing apparatus of the type including a rotational drive having a spindle for supporting and rotating a disk, and a tape transport mechanism for moving a texturing tape across and in pressed with a texturing surface of the disk, wherein the spindle of the rotational drive is arranged to support the disk in an eccentrically deviated position off the rotational axis of the rotational drive, causing the disk to revolve along an eccentrically deflecting orbit around the rotational axis while being rotated with the spindle, moving in and out in radial directions in a degree commensurate with the amount of eccentric deviation to form cross-pattern grooves on the surface of said disk.

The abrasive particles which are necessary for abrading the disk surface are either dispersed in an abrasive carrier liquid or deposited on the texturing tape. From the standpoint of efficiency of operation, it is preferable for the texturing apparatus to be arranged to texture both sides of a disk simultaneously rather than texturing one side of the disk each time. By pressed contact with the texturing tape, the disk is textured with a large number of intersecting fine grooves of the so-called cross pattern consisting of grooves of sinusoidal or meandering forms instead of grooves of circular or concentric forms.

In order to revolve the disk along an orbit moving radially toward and away from the rotational axis of the spindle while in rotation with latter, there may be employed a 1-axis (mono-axial) or 2-axis (bi-axial) rotational drive system. In the case of a mono-axial drive system, the disk is mounted on the spindle of the drive system in such a way that the center of the disk is located in a radially deviated position off the rotational axis of the spindle. By so doing, the disk is radially deflected while being rotated on the spindle. In the case of a bi-axial drive system, the disk is rotated on and by a spindle which has a rotational axis in alignment with the center of the disk, and in turn the spindle is eccentrically fitted in a rotary deflecting member which is driven from a separate rotational drive means to revolve the spindle and disk along an eccentric orbit moving in and out in radial direction relative to a texturing tape or tapes which are transported in pressed contact with disk surfaces.

In this instance, the spindle and rotary member are connected to rotational drives like electric motors, through direct coupling means or through transmission means such as transmission belts or gears. In the case of the bi-axial drive system, the intersecting angles of cross-pattern grooves can be adjusted by controlling the rotational speed of the spindle in relation with the frequency of radial deflections which are imparted to the spindle by the rotary deflecting member.

No matter whether the drive system is of the mono-axial type or bi-axial type, the disk should be kept from influences of centrifugal forces while being deflected in radial directions by eccentric orbiting. For this purpose, preferably the spindle is adjusted to have its center of gravity at the center of the disk, by putting on the spindle body a positive or negative counter weight which balances with the eccentric movements of the disk. However, the balancing adjustments by shift of the center of gravity of the spindle are not necessary in case the disk is radially deflected only in a small degree and free from influences of large centrifugal forces.

BRIEF DESCRIPTION OF THE DRAWINGS

The above and other objects, features and advantages of the invention will become apparent from the following particular description of the invention, taken in conjunction with the accompanying drawings which show by way of example some preferred embodiments of the invention and in which.

DESCRIPTION OF PREFERRED EMBODIMENTS

Figure 1:
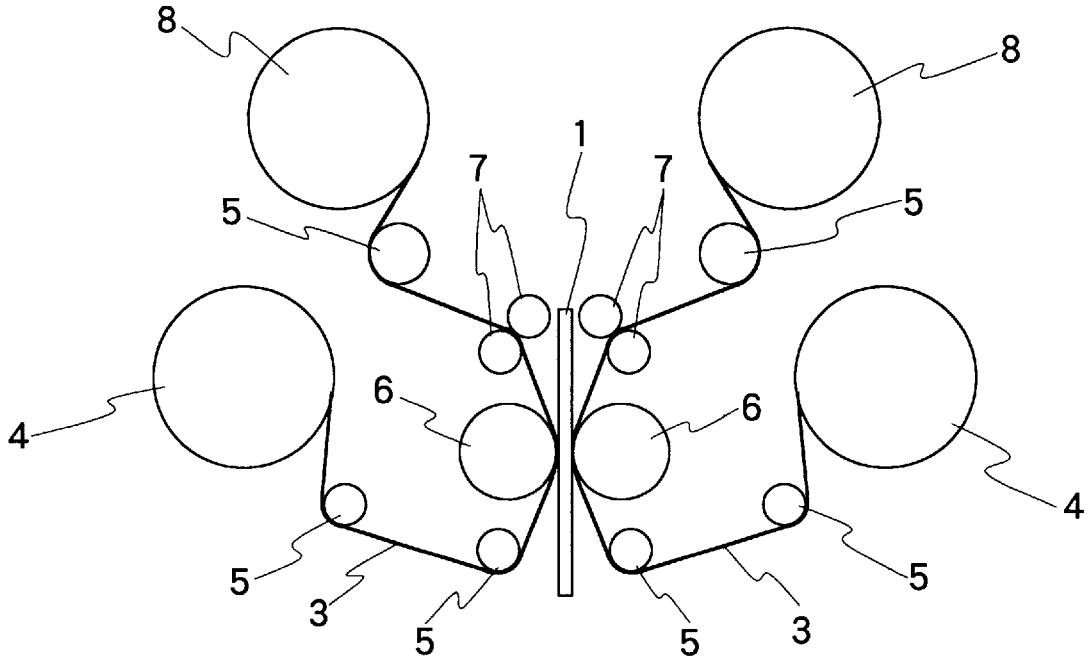
FIG. 1 is diagrammatic illustration of a disk texturing apparatus adopted as a first embodiment of the invention.

Hereafter, the present invention is described more particularly by way of its preferred embodiments shown in the drawings.

Figure 2:
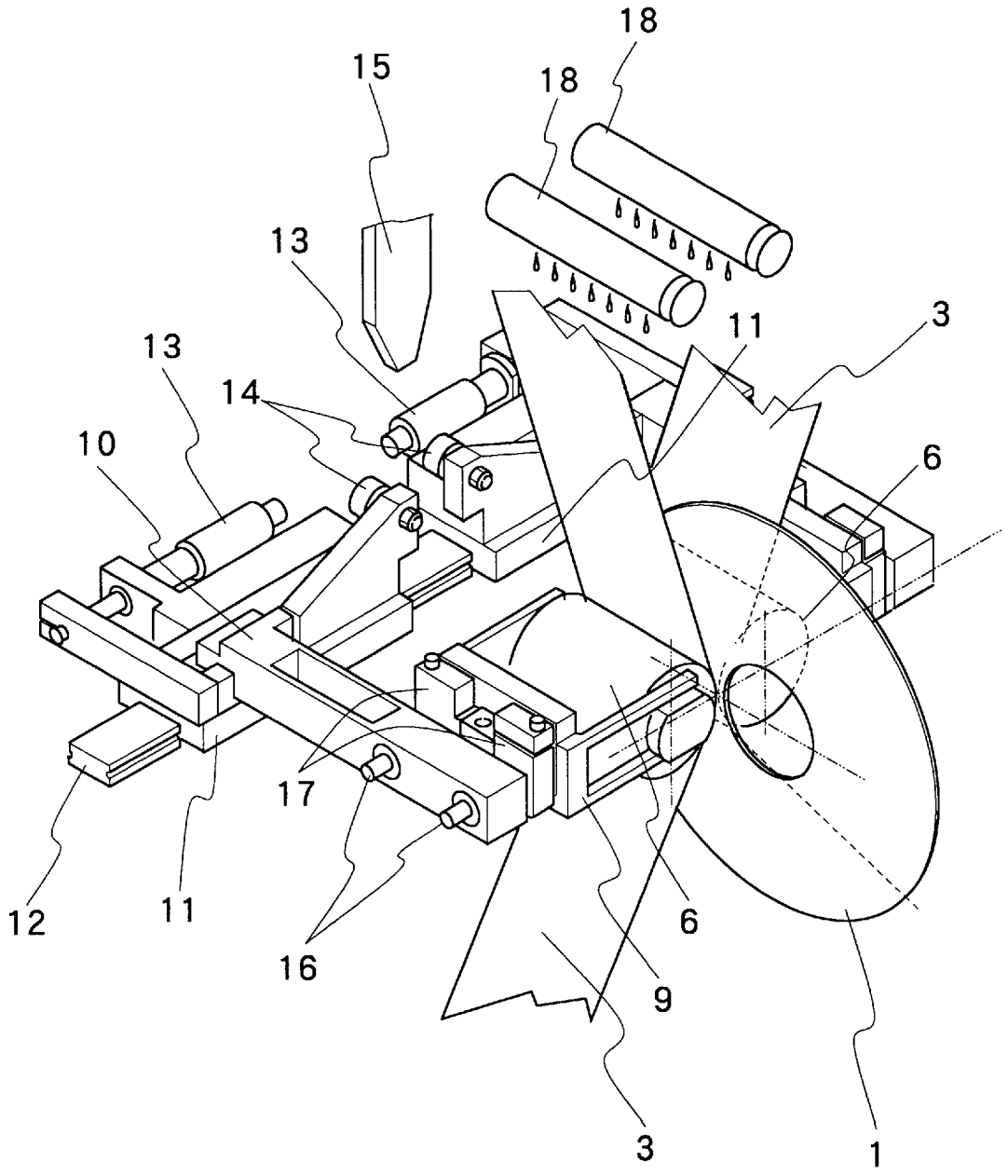
FIG. 2 is a schematic perspective view showing major component parts of the disk texturing apparatus.
Figure 3:
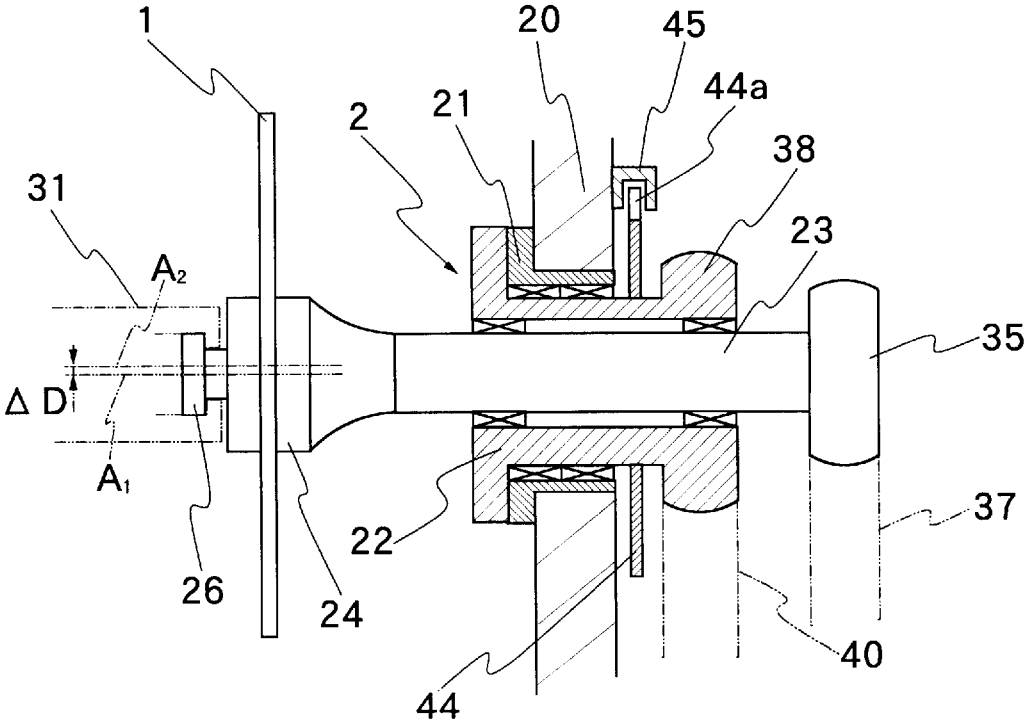
FIG. 3 is a patly sectioned schematic view of a disk rotating and deflecting mechanism.
Figure 4:
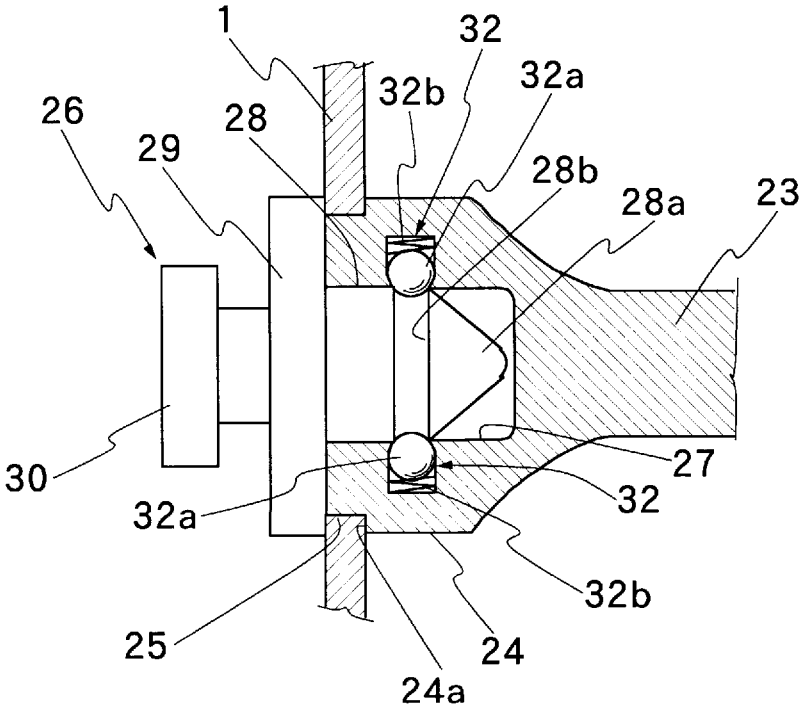
FIG. 4 is a schematic view of a disk holder.

Referring first to FIGS. 1 and 2, there is shown general layout of a disk texturing apparatus according to the present invention, useful for texturing the surface of a magnetic disk or the like with fine cross-pattern grooves as explained hereinbefore. In these figures, indicated at 1 is a magnetic disk which is clamped on a spindle assembly 2 for rotation therewith (FIGS. 3 and 4). While the disk 1 is put in rotation, front and rear disk surfaces are textured by sliding contact with texturing tapes 3 which are pressed against the opposite sides of the disk 1. Each texturing tape 3 is withdrawn from a feeder reel 4 and fed forward via a plural number of guide rollers 5 toward a pressing roller 6 which presses the tape 3 against a texturing surface of the disk 1 under predetermined loaded conditions. The texturing tape 3 leaving the disk 1 is pulled toward tape feed rollers 7 which are located on the downstream side of the pressing roller 6 and turned around a guide roller 5 to be wound on a take-up reel 8. In this instance, the above-described tape transport mechanism as well as the tape pressing mechanism is provided on each side of the disk 1.

The pressing roller 6 functions to press the texturing tape 3 against the disk 1 with a predetermined pressure. To apply a predetermined load on the disk 1 by the pressing roller 6, a parallel leaf spring 10 is connected to a support member 9 which supports the shaft of the pressing roller 6 on its arms. The parallel leaf spring 10 is connected at its base end to a slide block 11 which is movable linearly along a linear guide 12 for movements toward and away from the disk 1. Namely, the slide block 11 is driven by a piston-cylinder 13 back and forth along the linear guide 12. Each one of slide blocks 11 which are provided symmetrically for the pressing rollers 6 on the opposite sides of the disk 1 is provided with a roller 14 for abutting engagement with an inclined end surface of a stopper member 15 which delimits stroke ranges of the respective slide blocks 11.

Further, in order to permit adjustments of the load pressure, under which the texturing tape 3 is pressed against the disk surface by the roller 6, the parallel leaf spring 10 is connected to the support member 9 not directly but through load adjusting members 16 and load sensors 17. Accordingly, the load to be applied on the texturing tape 3 by the pressing roller 6 can be precisely set at an appropriate level by fine adjustments through the load adjusting members 16 while monitoring the reading of the load measured by the load sensors 17. As the texturing tapes 3 are pressed in pressed contact with front and rear surfaces of the disk 1, an abrasive carrier liquid having abrasive particles dispersed in a liquid carrier medium is supplied to the surfaces of the texturing tapes 3 which are abutted against the opposite sides of the disk 1, from abrasive liquid nozzles 18 located over the disk 1.

Shown in FIG. 3 is the construction of the spindle 2 and its drive mechanism. In this figure, indicated at 20 is a machine wall which supports a bearing block 21 thereon. A rotary deflecting member 22 of a hollow cylindrical shape is rotatably fitted in the bearing block 21 for rotation about an axis $A_1$. In turn, a spindle 23 is rotatably fitted in the rotary member 22 for rotation about an axis $A_2$ which is radially deviated from the rotational axis $A_1$ of the rotary member 22 by a distance ?D.

Provided at the fore end of the spindle 23 is a clamp mechanism for the disk 1. More specifically, the disk clamp mechanism is provided on a disk holder portion 24 which forms a radially bulged large-diameter portion at the fore end of the spindle 23. As seen particularly in FIG. 3, the disk holder portion 24 is provided with a stepped wall 24*a* behind a disk seating portion 25 of a reduced diameter corresponding to the inside diameter of the disk 1. The width of the disk seating portion 25 corresponds to the thickness of the disk 1. A socket or recess 27 is formed into the fore end face of the disk holder portion 24 of the spindle 23 to receive a clamp member 26.

The clamp member 26 includes a fitting portion 28 to be fitted in the recess 27, a flange-like disk stopper portion 29, and a grip portion 30 to be gripped by a clamp operating means at the time of putting the clamp member 26 on and off the disk holder portion 24 of the spindle 23. The fitting portion 28 is provided with a tapered end 28*a* for smooth placement into the recess 27 on the part of the disk holder portion 24, and with an annular groove 28*b* around its intermediate portion. The disk stopper portion 29 has an outside diameter which is substantially same as that of the disk holder portion 24 of the spindle 23, so that inner marginal edge portions of the disk 1 are securely gripped between the disk holder portion 24 of the spindle 23 and the disk stopper portion 29 of the clamp member 26. For placing the clamp member 26 into and out of the recess 27 on the disk holder portion 24, associated with the grip portion 30 is a clamp operating arm 31 which is provided with, for example, fingers to grip and move the clamp member 26 in the manner as indicated by imaginary line in FIG. 3.

Upon placing the clamp member 26 into the recess 27 on the disk holder portion 24 by operation of the clamp operating arm 31, the clamp member 26 is detachably locked in position within the recess 27 by a click mechanism 32 which is provided in the inner peripheral wall of the recess 27. More specifically, in the particular embodiment shown, the click mechanism 32 is constituted by steel balls 32*a* which are received in the inner peripheral wall of the recess 27 for engagement with the annular groove 28*b* on the fitting portion 28 of the clamp member 26, and click springs 32*b* constantly urging the steel balls 32*a* to protrude in radially inward directions to a predetermined extent from the inner periphery of the recess 27.

Figure 5:
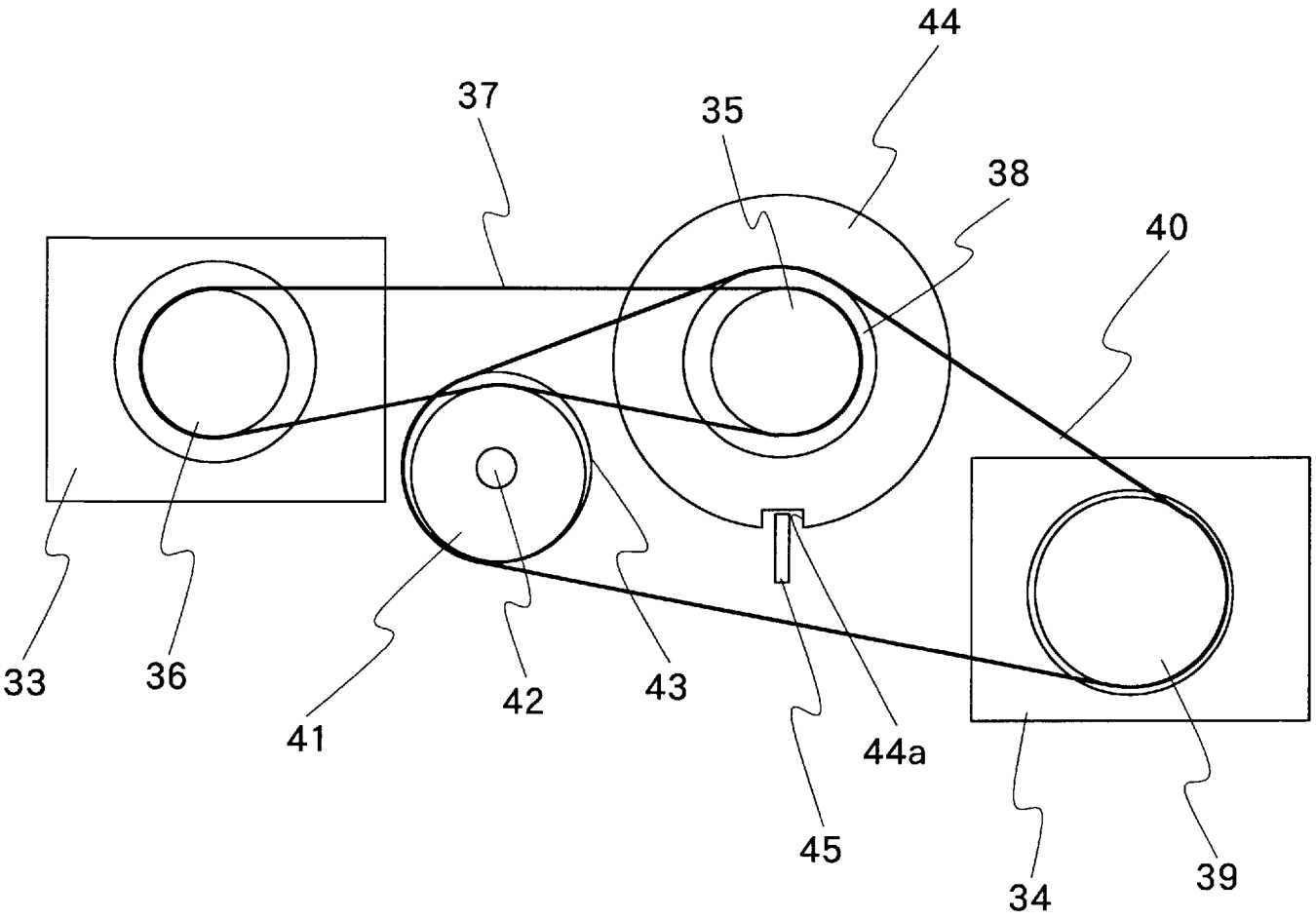
FIG. 5 is a diagrammatic illustration explanatory of disk rotating deflecting mechanisms.
Figure 6:
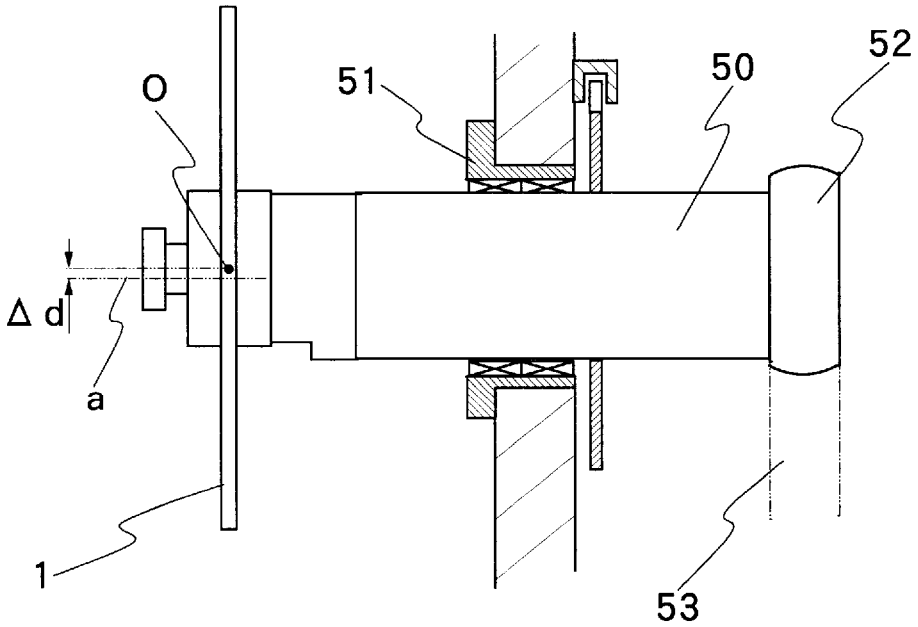
FIG. 6 is a partly sectioned schematic view of a disk rotating and deflecting mechanism adopted in a second embodiment of the present invention.

As described hereinbefore, the spindle assembly 2 is provided with a bi-axial rotational drive system for the spindle 23 and the deflecting rotary member 22. Besides, the rotational axis $A_2$ of the spindle 23 is located in an eccentric position which is radially deviated from the rotational axis $A_1$ of the rotary member 22 by a distance ?D. Therefore, as the spindle 23 and rotary deflecting member 22 are put in rotation in the same direction, the disk 1 which is set on the spindle 23 is rotated together with the spindle 23 about the axis $A_2$ and at the same time revolved along an eccentrically deflecting orbit around the rotational axis $A_1$ of the rotary deflecting member 22. Illustrated in FIG. 5 is a rotational drive system for the spindle 23 and rotary deflecting member 22.

As shown in that figure, the rotational drive system includes first and second motors 33 and 34 as rotational drive sources for the spindle 23 and rotary member 22, respectively. A first transmission belt 37 is lapped around pulleys 35 and 36 which are provided on the spindle 23 and the first motor 33, respectively. Similarly, a second transmission belt 40 is lapped around pulleys 38 and 39 which are provided on the rotary deflecting member 22 and the second motor 34, respectively. As the rotary deflecting member 22 is rotated, the rotational axis of the spindle 23 is radially displaced over a range which is two time as large as the distance ?D of radial deviation, so that the first transmission belt 37 needs to be slackened and tightened in timed relation with radial deflections of the spindle 23. For this purpose, the first transmission belt 37 is abutted against a cam member 41 which is rotatably supported on a rotational shaft 42 in such a way as to follow the rotation of the rotary member 22, that is, to vary the tension in the first transmission belt 37 in relation with the rotation of the rotary deflecting member 22. For this purpose, the second transmission belt 40 is lapped around a pulley 43 on the cam shaft 42 to rotate the cam member 41 in synchronism with the rotary deflecting member 22.

As a consequence, upon actuating the first and second drive motors 35 and 36 simultaneously, both of the spindle 23 and rotary deflecting member 22 start rotations about the two radially deviated axes. Accordingly, the disk 1 on the spindle 23 is rotated with the spindle 23, and at the same time revolved along an eccentric deflecting orbit around the rotational axis of the rotary member 22 at a radius of ?D. Since the spindle 23 is located eccentrically relative to the rotary deflecting member 22, there may arise difficulties in putting the disk 1 in smooth rotation particularly in case the center of gravity of the rotary deflecting member 22 is shifted largely away from the rotational center when the disk 1 is set on the spindle 23. In such a case, the rotational drive can be operated in balanced state by adjusting weight balances of the rotary member 22, for example, by putting on a positive or negative balancing weight on part of the rotary member 22.

In the above-described bi-axial drive system, the position of the spindle 23 changes depending upon the angular position of the rotary member 22. In this regard, it is desirable for the drive system to be able to stop the rotary member 22 always in a predetermined position to ensure smooth setting and unsetting of the clamp member 26 and disk 1. To this end, the rotary member 22 carries a circular position detecting plate 44 which is provided with a slit or notch 44*a* in a predetermined angular position at its outer peripheral edge. This slit 44*a* indicative of a predetermined angular position is detected by a sensor 45 which is mounted on the machine wall 20. On the basis of output signal of the sensor 45, the operation of the second motor 34 is controlled to let the rotary member 22 take a predetermined angular position constantly when stopped.

Thus, in operation, while the clamp member 26 is detached from the disk holder portion 24 at the fore end of the spindle 23, a disk 1 is set on the disk seating portion 25 by the use of a suitable handling means until the disk 1 is abutted against the stepped wall 24*a*. After setting the disk 1 in this state, the clamp member 26 is fitted into the recess 27 on the disk holder portion 24 by the clamp operating means 31, bringing the groove 28*b* on the fitting portion 28 of the clamp member 26 into engagement with the steel balls 32*a* of the click mechanism 32. As a result, the disk 1 is clamped in position on the disk seating portion 25, firmly gripped between the stepped wall 24*a* of the disk holder 24 and the disk stopper portion 29 of the clamp member 26. After this, the disk handling means and clamp operating means 31 are moved away into the respective receded positions, leaving the disk 1 on the spindle assembly 2.

Then, the first and second motors 33 and 34 are started to drive the spindle 23 and rotary deflecting member 22 into rotation, respectively. In this state, the pressing rollers 6 are brought into abutting engagement with the front and rear sides of the disk 1, pressing thereagainst the texturing tapes 3 which are being fed along predetermined tape transport paths by the tape feed rollers 7. Simultaneously, an abrasive carrier liquid containing abrasive particles is dripped onto the texturing tapes from the nozzles 18, onto tape portions which are in engagement with or about to engage the texturing surfaces of the disk. By scratching or abrading actions of the abrasive particles in the abrasive carrier liquid, the disk surfaces are textured with fine grooves.

During the texturing operation, the disk 1 is rotated together with the spindle 23, which in turn is revolved along an eccentric orbit around the rotational axis of the rotary deflecting member 22 at a radius of ?D. Namely, the rotating disk 1 on the spindle 23 is simultaneously revolved along a radially deflecting orbit around the rotational axis $A_1$ of the rotary deflecting member 22 at a radius of ?D. As a result of radial deflections of the disk 1 in rotation, a large number of fine intersecting grooves of sinusoidal pattern or of the so-called cross-pattern grooves are formed on the surfaces of the disk 1, instead of concentric circumferential grooves.

In forming cross-pattern grooves in this manner, neither the disk 1 nor the texturing tapes 3 is put in straight reciprocating movements, so that it becomes possible to form fine cross-pattern grooves smoothly with extremely high precision even if the speeds of the rotation (about the rotational axis of the spindle) and revolution (eccentric orbiting around the axis of the rotational axis of the rotary deflecting member) of the disk 1 are increased for higher operational efficiency. Besides, although the disk 1 is mounted on the spindle 23 which is located in an eccentric position relative to the rotary member 22, vibrations of the disk 1 can be further suppressed by adjusting the weight balances of the rotary member 22 to have its center of gravity at the center of rotation of the spindle head. Moreover, the shape of cross-pattern grooves, for example, the intersecting angle of the cross-pattern grooves can be controlled in a facilitated manner and to a fine level by varying the ratio of the rotational speed of the spindle 23 to that of the rotary member 22. In this regard, in case the spindle 23 is put in rotation at a constant speed, the number of intersections per rotation is increased as the rotational speeed of the rotary deflecting member 22 becomes higher than that of the spindle 23, and conversely reduced as the rotational speed of the rotary deflecting member 22 becomes lower than that of the spindle 23.

In the disk texturing operation as described above, the texturing apparatus is required to have a high degree of accuracy in crossing textire grooves on the disk surface and also in forming fine grooves of substantially uniform widths and depths over the entire texturing surface. Especially, from the standpoint of magnetic orientation, it is a paramount requisite for the texturing apparatus to be able to form fine grooves uniformly over the entire texturing area. It this connection, it is also important to preclude formation of burrs which would in many cases stick out on the surface of the disk 1 as a result of the surface abrading operation.

In this regard, if the texturing tape 3 is linearly reciprocated back and forth in the radial direction along the texturing surface of the disk 1 together with the pressing roller 6, it will be very likely that the disk 1 be vibrated at each stroke end of the reciprocating movements under the influence of inertial forces even if driven component parts are of lightweight nature. The vibrations of the disk 1 impose adverse effects on the texturing operation, e.g., by varying the widths and depths of grooves to be formed or by applying a large load on the texturing tape and causing abrasive particle to scrape the disk surface to such an excessive degree as would led to formation of burrs. According to the present invention, instead of back and forth reciprocating movements, the disk 1 is put in revolving movements along an eccentric orbit as explained hereinbefore, free of vibrational disturbances which would impair formation of uniform grooves or would contribute to the production of burrs. In addition, by the revolving movements of the rotating disk 1, the abrasive particles between the texturing tape 3 and the disk 1 are caused to glide on the disk surface continuously in a serpentine-like fashion. Accordingly, simply by adjusting the load to be applied by the pressing rollers 6, it becomes possible to texture the surfaces of the disk 1 uniformly with cross-pattern grooves of desired fineness. Further, it suffices to revolve the disk 1 along an eccentric orbit of a relatively small radius. For example, fine and high precision textures can be obtained by revolving the disk 1 along an orbit having a radius ?D of 1 mm or smaller.

Referring now to FIG. 5, there is shown a second embodiment of the present invention, i.e., a texturing apparatus with a mono-axial drive system. As seen in this figure, similarly a disk 1 is detachably clamped on a disk holder portion at the fore end of a spindle 50, which is rotatably supported in a bearing member 51. Similarly to the foregoing first embodiment, the spindle 50 is driven from a motor, which is not shown, through a transmission belt 53 and a pully 52 which is mounted on a rear end portion of the spindle 50. In this case, the center "O" of the disk 50, which is clamped on the spindle 50, is located in a radially shifted position with a deviational distance ?d from the rotational axis "a". Consequently, as the disk 1 is rotated with the spindle 50, it is simultaneously revolved around the rotational axis along an eccentric orbit having a radius of ?d to form cross-pattern grooves.

Of course, in the case of this mono-axial drive system, it is not possible to vary the rotational and orbiting speeds relative to each other for the purpose of changing the texture groove pattern. However, the mono-axial rotational drive has an advantage in that it is extremely simplifed in construction and yet still capable of forming fine cross-pattern grooves on the disk surfaces, free of disturbing vibrations as would be imposed on the disk when the disk 1 or texturing tape 3 in put in linar reciprocating movments in radial direction. In this instance, despite the eccentric setting of the disk 1 on the spindle 50, the spindle 50 can be rotated in balanced state by adjusting its weight balances, e.e., by putting on the spindle 50 a positive or negative counter weight which offsets the eccentric positioning of the disk 1.

What is claimed is:

1. A disk texturing apparatus for texturing surfaces of a magnetic disk, including a rotational drive mechanism having a spindle for supporting and rotationally driving a disk, and a tape transport mechanism with a tape pressing means for pressing an abrasive tape against a texturing surface of said disk, wherein:

said spindle of said rotational drive mechanism is arranged to rotate said disk eccentrically about a rotational axis of said rotational drive mechanism, causing said disk to reciprocate in and out in a radial direction thereof; and said tape pressing means of said tape transport mechanism is arranged to press said texturing tape against a disk surface at a fixed position in the radial direction, maintaining sliding contact with said disk surface along a zigzag line in the rotational direction of said disk in relation with reciprocating movements of said disk to impart a cross-pattern groove texture to said disk surface.

2. A dis texturing apparatus as defined in claim 1, wherein said spindle is provided with a clamp mechanism in a fore end portion to clamp said disk in said eccentrically deviated position.

3. A disk texturing apparatus as defined in claim 1, wherein said spindle is arranged to hold said disk in a concentric position and fitted eccentrically in a rotary deflecting member to be rotated in timed relation with said spindle to revolve said disk along an eccentrically deflecting orbit together with said spindle around the rotational axis of said rotational drive.

4. A disk texturing apparatus as defined in claim 3, wherein said spindle is driven from a motor and connected to the latter through a transmission belt and a tension adjusting means adapted to absorb slackening and tightening of said transmission belt resulting from raidal deflecting movements of said spindle within said rotary deflecting member.

5. A disk texturing apparatus as defined in claim 1, wherein said rotational drive is provided with a counter balance means to offset the eccentric positioning of said disk.

* * * * *